US006796845B2

(12) United States Patent
Kuiken et al.

(10) Patent No.: US 6,796,845 B2
(45) Date of Patent: Sep. 28, 2004

(54) MODULAR CONNECTOR ANTI-SNAG ENHANCEMENT

(75) Inventors: David Paul Kuiken, Round Rock, TX (US); Mark Daniel Rogalski, Leander, TX (US); Paul Anthony Thayer, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/339,756

(22) Filed: Jan. 9, 2003

(65) Prior Publication Data

US 2004/0137798 A1 Jul. 15, 2004

(51) Int. Cl.[7] ..... H01R 24/04
(52) U.S. Cl. ..... 439/668; 439/681; 439/676
(58) Field of Search ..... 439/668, 681, 439/676

(56) References Cited

U.S. PATENT DOCUMENTS 5,462,457 A * 10/1995 Schroepfer et al. ..... 439/736
5,600,885 A 2/1997 Schroepfer et al. ..... 29/883
5,613,869 A * 3/1997 Erlich et al. ..... 439/344
6,174,190 B1 * 1/2001 Tharp et al. ..... 439/352
6,196,733 B1 * 3/2001 Wild ..... 385/86
6,238,231 B1 * 5/2001 Chapman et al. ..... 439/404
6,250,817 B1 * 6/2001 Lampert et al. ..... 385/56
6,254,418 B1 * 7/2001 Tharp et al. ..... 439/352
6,364,685 B1 * 4/2002 Manning ..... 439/357
D466,479 S * 12/2002 Pein et al. ..... D13/147
6,511,230 B1 * 1/2003 Connelly et al. ..... 385/58
2002/0132532 A1 * 9/2002 Henneberger ..... 439/676

OTHER PUBLICATIONS

Terry R. Cobb *The High Density Standard for Premises Networks*, IEEE 802.5, Nov. 1998.

* cited by examiner

*Primary Examiner*—Michael C. Zarroli
(74) *Attorney, Agent, or Firm*—Volel Emile; Marilyn S. Dawkins

(57) ABSTRACT

A modular connector with an integrated anti-snag feature is provided. The modular connector has a first flexible tab attached at a first end of the connector. The first flexible tab has a first and a second part. The first part is connected to and projected upward and away from the first end of the connector and the second part is angled downward toward a second end of the connector but unattached thereto. The first part meets with the second part at a flexible intersection whereby a force exerted onto either the first part or the second part is enabled to depress the flexible first tab downward. The connector also has a second flexible tab. The second flexible tab is attached at the second end of the connector and is projected at an angle toward the first flexible tab. The first end and second end of the connector are at opposite ends of each other. The second flexible tab is used to prevent the connector from snagging on objects such as cables, components etc. The connector may snag on an object if the object becomes lodged between the first flexible tab and the connector.

2 Claims, 5 Drawing Sheets

MODULAR CONNECTOR ANTI-SNAG ENHANCEMENT

BACKGROUND OF THE INVENTION

1. Technical Field

The present invention is directed generally to electrical cables. More specifically, the present invention is directed to an electrical cable terminated with a modulator connector fitted with a flexible tab having a tendency to snag.

2. Description of Related Art

Electronic devices, such as computer components, sometimes are stored in electronics rack systems to conserve floor space. These computer components may include servers, computer systems, storage devices (i.e., disk drives, tape drives, and redundant array of independent or inexpensive disk (RAID) drives), and other electrical devices. The rack systems typically have a number of cables protruding in the rear. These cables include power cables as well as input and output cables that connect one component to another or to other systems housed within the same rack systems and/or elsewhere.

Most input and output cables are terminated with a connector, such as a registered jack (RJ) type modular connector (i.e., RJ-11, RJ-12, RJ-45 etc.), to connect the various components to each other. The RJ-type modular connectors have a flexible tab adapted to latch and unlatch the connector from another mating connector. The tab is attached to one end of the modular connector and projects outward from the point of attachment. Thus, there is a space or opening formed between the projected end of the tab and the connector. This renders the cable to which the modular connector is attached susceptible to snagging.

For example, the cables are usually run under raised floors, across floors, behind rack systems and furniture, above ceilings, in walls and other paths to interconnect the components. When, for any reason, a cable needs to be retrieved, it is often pulled from one end through the path it was installed. During the retrieval, another cable or any other object along the path may become lodged in the opening. When that occurs, the cable may snag. If the user continues to pull on the cable while it is thus snagged, the tab may snap off and render the cable unusable.

Currently, connectors have been fitted with a rubber boot that is placed over the tab of the modular connectors to prevent objects from entering into the opening. One such fitted connector is disclosed in U.S. Pat. No. 5,600,885, issued to Richard C. Schroepfer on Feb. 11, 1997. However, the rubber boot can sometimes make it difficult for a user to depress the tab when unlatching the modular connector from a device. Consequently, users have sometimes taken the rubber boot off the tab to easily depress the tab. This action circumvents the purpose of the rubber boot, especially if the rubber boot is not placed back over the tab afterward.

Consequently, what is needed is a cable having modular connectors with an integrated feature that prevents snagging.

SUMMARY OF THE INVENTION

The present invention provides a modular connector with an integrated anti-snag feature. The modular connector has a first flexible tab attached at a first end of the connector. The first flexible tab has a first and a second part. The first part is connected to and projected upward and away from the first end of the connector and the second part is angled downward toward a second end of the connector but unattached thereto.

The first part meets with the second part at a flexible intersection whereby a force exerted onto either the first part or the second part is enabled to depress the flexible first tab downward. The connector also has a second flexible tab. The second flexible tab is attached at the second end of the connector and is projected at an angle toward the first flexible tab. The first end and second end of the connector are at opposite ends of each other. The second flexible tab is used to prevent the connector from snagging on objects such as cables, components etc. The connector may snag on an object if the object becomes lodged between the first flexible tab and the connector.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1(*b*) depicts a side view of an RJ-type modular connector.

FIG. 2(*b*) depicts a second modulator connector with an integrated anti-snag enhancement.

DETAILED DESCRIPTION OF THE PREFERRED EMBODIMENT

Figure 1A:
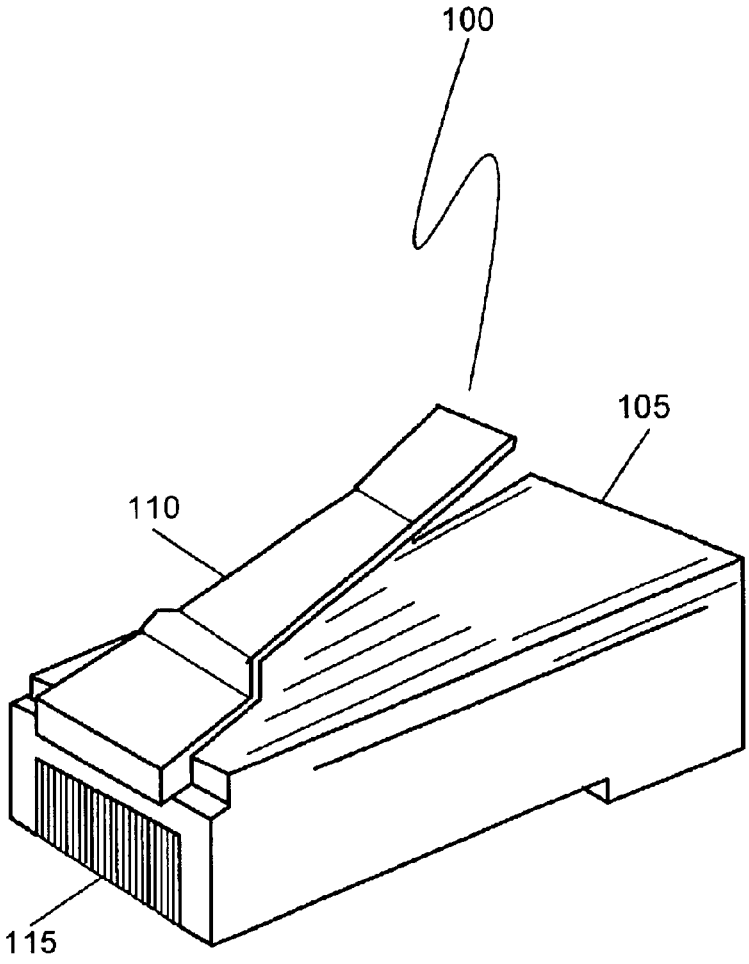
FIG. 1(a) (PRIOR ART)
FIG. 1(*a*) depicts an isometric view of an RJ-type modular connector.
Figure 1:
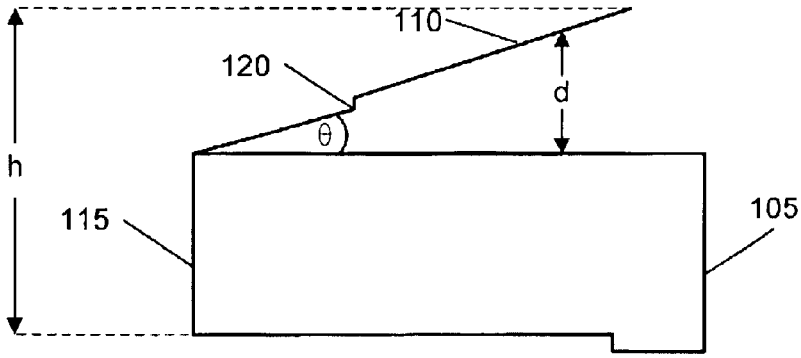
FIG. 1 (b) (PRIOR ART)

Turning to the figures, wherein like numbers denote like parts throughout, FIG. 1(*a*) depicts an isometric view of a prior art RJ-type modular connector 100. The modular connector has an end 105 to which a cable (not shown) may be attached. The cable would typically be attached to another RJ-type connector at its other end. The modular connector has an end 115 which contains a plurality of connector pins. The connector pins are used to transfer electrical and signal connections between any two electronic components to which the cable may be connected.

The RJ-type modular connector 100 also has a flexible tab 110. The flexible tab 110 is attached to the modular connector at end 115 and forms an angle e with the body of the connector (see FIG. 1(*b*)). The other end of the flexible tab 110 is not attached to the modular connector 100 and is at a distance d away from the connector. Thus, an opening "d" is formed between the flexible tab 110 and the connector 100.

As mentioned above, when for any reason a cable is being retrieved, it is usually pulled from one end through the path it was installed. During the retrieval, another cable or any other item along the retrieval path may enter into opening "d" and become lodged therein (i.e., between the flexible tab 110 and the connector 100). When that occurs, and the user continues to pull, the tab may snap off and render the cable unusable. The present invention provides a modular connector with an integrated anti-snag enhancement.

Figure 2A:
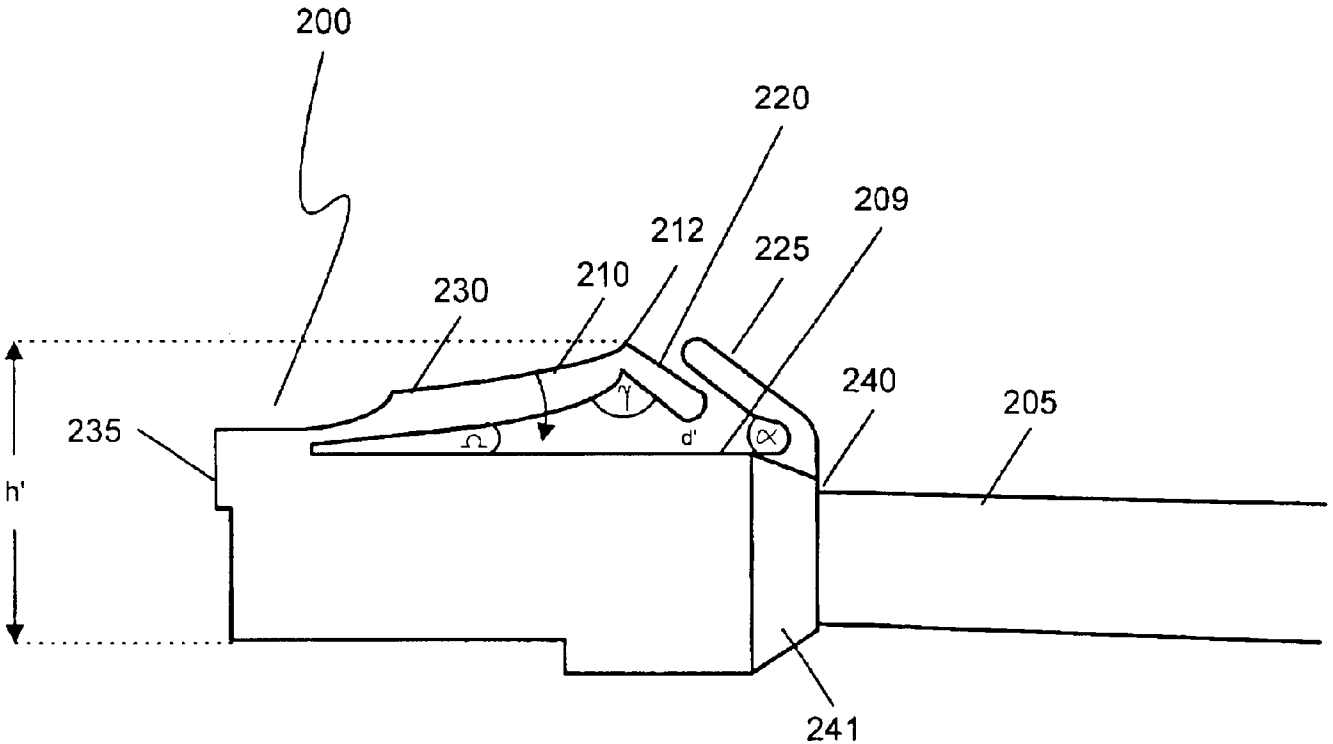
FIG. 2(*a*) depicts a first modulator connector with an integrated anti-snag enhancement.
Figure 2B:
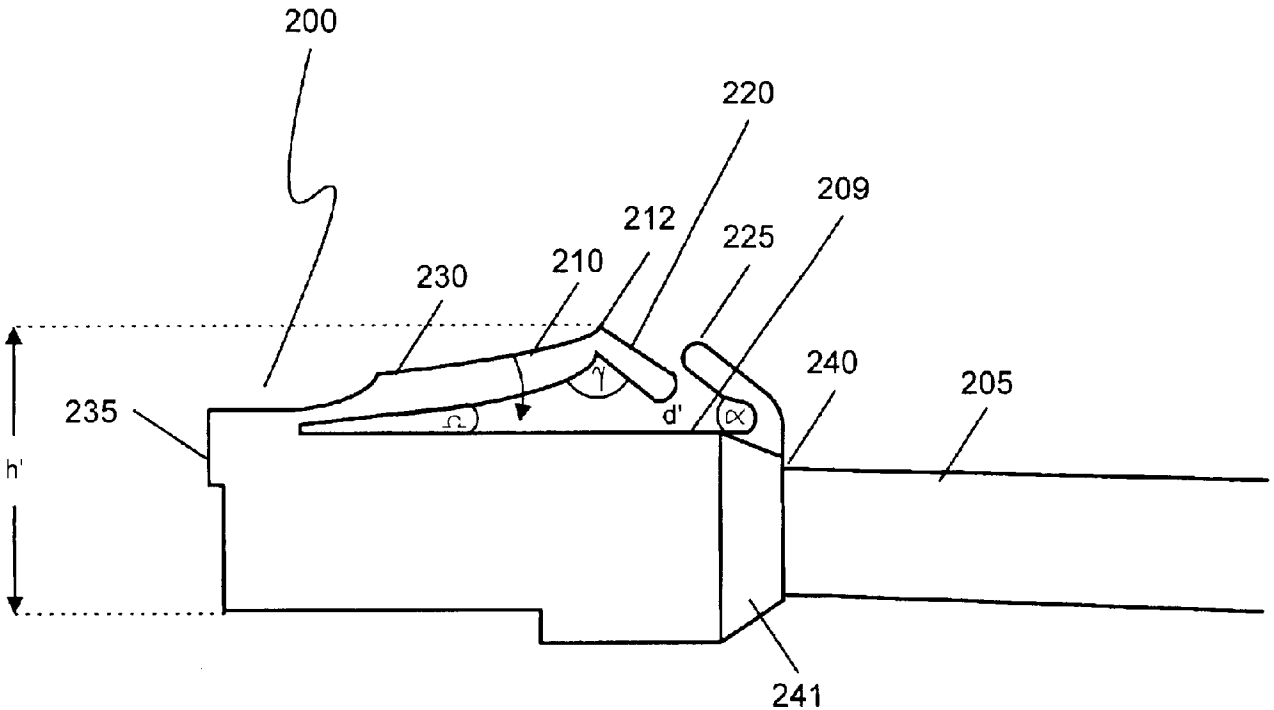

FIGS. 2(*a*) and (*b*) depict such an anti-snag enhancement. In FIGS. 2(*a*) and (*b*), a cable 205 is shown attached to an end 240 of a modular connector 200. The modular connector 200 has a first flexible tab 210 and a second flexible tab 225. The first flexible tab 210 is attached to end 235 of the modular connector 200.

The first flexible tab 210 has a first part 230 and a second part 220. The first part is at an angle Ω from upper surface 209 of modular connector 200. Thus, the first part 230 is angled upward and away from the modular connector 200. The second part 220 is angled downward and toward the connector 200. However, the second part 220 is unattached to the connector 200 and is at a distance from the upper surface 209 creating opening d'. The first part 230 of the first flexible tab 210 meets with the second part 220 at a flexible intersection 212 forming angle γ.

The second flexible tab 225 is attached at end 240 of the modular connector 200. The second flexible tab 225 is at an angle a from the modular connector and is disposed such that it is angled toward the second part 220 of the first flexible tab 210. Angle α is greater than angle Ω. In this configuration, the second flexible tab 225 precludes objects such as other cables etc. from entering into opening d' when the cable 205 is being retrieved. Hence, the second flexible tab 225 prevents the cable 205 from snagging. Further, the end 240 of the modular connector 200 is tapered. This inhibits wires, cables, components etc. from impeding the retrieval of cable 205.

To unlatch (and latch) the modular connector 200 from a mating connector (not shown), the first flexible tab 210 has to be depressed. That is, a downward force must be exerted on the first flexible tab 210 to move the flexible tab 210 in the direction of the arrow. The force may be directly exerted onto the flexible tab 210 on either first part 230 or second part 220 or the force may be exerted on second flexible tab 225.

In order to have the first flexible tab 210 be depressed when either first part 230 or second part 220 is depressed, y must be at least a wide enough angle. Further, to have the first flexible tab 210 be depressed when a force is exerted on the second flexible tab 225, the second flexible tab 225 must be long enough such that it may appropriately depress the first flexible tab 210.

In a particular embodiment, the length of the second flexible tab 225 is such that it is of the same height as the first flexible tab 210 (see FIG. 2(*a*)). Note, however, that the length of the second flexible tab 225 may be reduced without adversely affecting the invention. The reduced length of the second flexible tab 225 is shown in FIG. 2(*b*).

As shown in FIGS. 2(*a*) and (*b*), the modular connector 200 including both flexible tabs 210 and 225 has a height h'. This height is less than height h of the prior art modular connector shown in FIG. 3. This is made possible by having first part 230 angled upward and second part 230 angled downward. Hence, the connector of the present invention is enabled to have a profile no higher than that of conventional connectors. This can be a quite an enviable feature. For example, in certain environments, the back of a rack system can be rather crowded with electronic devices and cables. Thus sometimes, there may not be enough space between any two adjacent modular connectors to allow a user to easily depress the flexible tab 210. The connector of the present invention provides the needed space. Note that in an embodiment, the modular connector of the present invention may be made longer than a conventional connector. The added length may additionally contribute to the lower profile of the connector.

Figure 3:
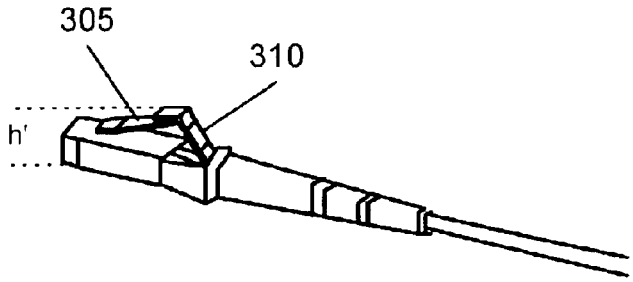
FIG. 3 depicts a prior art connector with an integrated anti-snag tab.

FIG. 3 depicts a connector 300 with an integrated anti-snag tab. The connector 300 includes a tab 305 and an anti-snag tab 310. As shown, the anti-snag tab 310 projects above tab 305. Consequently, given a length of a connector and an angle at which the tab is disposed, the present invention will have a lower overall height than connectors with integrated anti-snag tabs.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A cable for interconnecting electronic components comprising:

an anti-snag modular connector having a connector housing, a connecting end and a cable end, the connecting end being an end at which the connector housing connects with a mating connector, the cable end being an end that is attached to the cable, the cable end being opposite the connecting end, the anti-snag modular connector including:

a first flexible tab attached at the connecting end of the connector, the first flexible tab making an angle Ω with the connector housing and having a first and a second part, the first part being connected to and projecting upward and away from the connecting end of the connector, the second part angled downward toward the cable end of the connector but unattached thereto, the first part meeting with the second part at a flexible intersection whereby a force exerted onto either the first part or the second part is enabled to depress the flexible first tab downward; and a second flexible tab attached at the cable end of the connector, the second flexible tab making an angle α with the connector housing and being of a height lower than the first flexible tab and being enabled to prevent the first flexible tab from snagging on objects and to depress the first flexible tab when depressed.

2. The cable of claim 1 wherein the second end of the connector is tapered.

* * * * *